US012104794B2

(12) United States Patent
Witham

(10) Patent No.: US 12,104,794 B2
(45) Date of Patent: Oct. 1, 2024

(54) COMBUSTOR ASSEMBLY

(71) Applicant: ROLLS-ROYCE plc, London (GB)

(72) Inventor: Frederic Witham, Bristol (GB)

(73) Assignee: ROLLS-ROYCE plc, London (GB)

( * ) Notice: Subject to any disclaimer, the term of this patent is extended or adjusted under 35 U.S.C. 154(b) by 0 days.

(21) Appl. No.: 18/226,978

(22) Filed: Jul. 27, 2023

(65) Prior Publication Data

US 2024/0053010 A1 Feb. 15, 2024

(30) Foreign Application Priority Data

Aug. 9, 2022 (GB) ..... 2211589

(51) Int. Cl.
*F23R 3/28* (2006.01)
*F23R 3/00* (2006.01)

(52) U.S. Cl.
CPC ..... *F23R 3/283* (2013.01); *F23R 3/002* (2013.01); *F23R 2900/00005* (2013.01);
(Continued)

(58) Field of Classification Search
CPC ..... F23R 3/283; F23R 3/002; F23R 2900/00005; F23R 2900/00012; F23R 2900/03042; F23R 2900/03043
See application file for complete search history.

(56) References Cited

U.S. PATENT DOCUMENTS 4,361,010 A 11/1982 Tanrikut et al.
4,365,470 A 12/1982 Matthews et al.
(Continued)

FOREIGN PATENT DOCUMENTS

EP 1 258 681 A2 11/2002
EP 1 710 503 A1 10/2006
(Continued)

OTHER PUBLICATIONS

Mar. 14, 2023 Search Report issued in British Patent Application No. 2213352.4.
(Continued)

*Primary Examiner* — Gerald L Sung
*Assistant Examiner* — Rene D Ford
(74) *Attorney, Agent, or Firm* — Oliff PLC

(57) ABSTRACT

A combustor assembly for gas turbine engine, combustor assembly including: combustor wall including interior surface and combustor wall opening, wherein interior surface partially defines combustion chamber, wherein combustor wall opening extends between combustion chamber and its exterior; sealing element disposed partially within combustor wall opening and includes air inlet, air outlet and air passageway, wherein air outlet exits into combustion chamber and delivers flow of air received from exterior of combustion chamber via air inlet and air passageway to combustion chamber; and fuel nozzle coupled to sealing element and configured to deliver fuel into combustion chamber, wherein combustor wall further includes first bearing surface and sealing element further includes second bearing surface, wherein first bearing surface is concave and forms part of first spherical surface such that first and second bearing surfaces are configured to move relative to each other about central point of first spherical surface.

13 Claims, 7 Drawing Sheets

(52) U.S. Cl.
CPC ..... *F23R 2900/00012* (2013.01); *F23R 2900/03042* (2013.01); *F23R 2900/03043* (2013.01)

(56) References Cited

U.S. PATENT DOCUMENTS

| | | | | |
|---|---|---|---|---|
| 4,454,711 | A * | 6/1984 | Ben-Porat | F23R 3/10 60/800 |
| 4,686,823 | A * | 8/1987 | Coburn | F23R 3/283 60/800 |
| 4,864,827 | A * | 9/1989 | Richardson | F23R 3/002 60/755 |
| 4,916,905 | A | 4/1990 | Havercroft et al. | |
| 5,012,645 | A | 5/1991 | Reynolds | |
| 2002/0178734 | A1* | 12/2002 | Stastny | F23R 3/283 60/804 |
| 2007/0256418 | A1* | 11/2007 | Mueller | F23R 3/00 60/752 |
| 2008/0236169 | A1* | 10/2008 | Hawie | F23R 3/10 60/779 |
| 2015/0285497 | A1 | 10/2015 | Sandoval | |
| 2016/0169522 | A1 | 6/2016 | Cunha et al. | |
| 2017/0276356 | A1 | 9/2017 | Mulcaire | |
| 2018/0003385 | A1 | 1/2018 | Rodrigues et al. | |
| 2019/0145524 | A1* | 5/2019 | Clemen | F16J 15/162 277/411 |
| 2021/0102701 | A1 | 4/2021 | Freeman et al. | |

FOREIGN PATENT DOCUMENTS

| | | |
|---|---|---|
| EP | 3 543 609 A1 | 9/2019 |
| GB | 2548585 A | 9/2017 |

OTHER PUBLICATIONS

Feb. 6, 2023 Search Report issued in British Patent Application No. 2211589.3.

U.S. Appl. No. 18/226,975, filed Jul. 27, 2023 in the name of Frederic Witham.

Jan. 19, 2024 Search Report issued in European Patent Application No. 23185270.8.

Dec. 4, 2023 Extended European Search Report Issued in European Patent Application No. 23185269.0.

Jun. 11, 2024 Office Action issued in U.S. Appl. No. 18/226,975.

* cited by examiner

COMBUSTOR ASSEMBLY

This disclosure claims the benefit of UK Patent Application No. GB 2211589.3, filed on 9 Aug. 2022, which is hereby incorporated herein in its entirety.

FIELD OF INVENTION

The present disclosure relates to a combustor assembly for a gas turbine engine.

BACKGROUND

Gas turbine engines typically comprise a combustor in which combustion tales place. Fuel is combined with high pressure air and combusted, and the resulting high temperature gases are exhausted to drive the turbine. Typical combustors, such as the combustor 1 shown in FIG. 1, have an annular configuration. The combustor 1 comprises a combustor liner 4 or wall, which defines a combustion chamber 5. A fuel injector nozzle 2 or fuel spray nozzle interfaces with the liner 4 via an aperture 6 and delivers fuel into the combustion chamber 5. The combustor wall can often be protected from the combustion gases by a heatshield, which also has an aperture corresponding to the aperture of the combustor liner.

During operation of the engine, the combustor liner 4 and the fuel spray nozzles 2 are subject to relative movement as a result of being mounted at different locations within the engine and being exposed to different temperatures, and thus having different rates of thermal expansion. It is therefore important to control the relative positions of the combustor liner 4 (and associated heatshield) and the fuel spray nozzles 2 to maximise combustion efficiency. It is known to provide a burner seal 3 positioned between each of the fuel spray nozzles 2 and the respective aperture 6 of the combustor liner (and heatshield), which allows a limited amount of relative movement between the fuel spray nozzle 2 and the combustor liner 4.

The relative movement of the burner seal 3 and the combustor liner 4 is planar, due to the planar geometry of the combustor wall 7 which interfaces with the planar geometry of the burner seal 3. In such arrangements, during engine operation, the burner seal 3 is exposed to hot combustion gases from the combustion chamber 5 and therefore needs to be cooled. To cool the burner seal, cooling air can be directed through the burner seal 3 and exhausted into the combustion chamber 5. The fuel spray nozzles 2 deliver fuel into the combustion chamber 5 and this fuel is mixed with high-pressure air such that this fuel-air mixture forms a main fluid flow which is combusted in the combustion chamber. This main fluid flow forms a conical flow profile in the combustion chamber 5. Due to the planar geometry of the burner seal 3 and combustor liner 4 and/or heatshield and the conical flow profile of the main fluid flow, the main fluid flow cannot remain attached to the combustor liner 4. This causes some fluid flow to be recirculated within the combustion chamber 5 and become separated from the main fluid flow. This recirculated fluid flow has increased residence time in the combustion chamber 5 relative to other gases in the combustion chamber. This variation in residence time means that the combustor cannot be designed with optimum fuel-air ratios and residence times for all portions of gas moving through the combustor and therefore combustion efficiency is reduced and the production of undesirable exhaust emissions is increased.

There is therefore a need to develop a combustor assembly which addresses some or all of the aforementioned problems.

SUMMARY OF INVENTION

According to a first aspect of the present disclosure, there is provided a combustor assembly for a gas turbine engine, the combustor assembly comprising: a combustor wall comprising an interior surface and a combustor wall opening, wherein the interior surface at least partly defines a combustion chamber, wherein the combustor wall opening extends between the combustion chamber and an exterior of the combustion chamber; a sealing element disposed at least partially within the combustor wall opening, the sealing element comprising an air inlet, an air outlet and an air passageway fluidically coupling the air inlet and the air outlet, wherein the air outlet exits into the combustion chamber and is configured to deliver a flow of air received from the exterior of the combustion chamber via the air inlet and the air passageway to the combustion chamber; and a fuel nozzle coupled to the sealing element and configured to deliver fuel into the combustion chamber, wherein the combustor wall further comprises a first bearing surface and the sealing element further comprises a second bearing surface, wherein the first bearing surface and the second bearing surface are configured to contact and move relative to each other, wherein the first bearing surface is concave and forms part of a first spherical surface such that the first bearing surface and the second bearing surface are configured to move relative to each other about a central point of the first spherical surface.

The second bearing surface may form part of a second spherical surface.

The first spherical surface may correspond to the second spherical surface.

The sealing element may comprise an annular body. A variable annular clearance may be defined between a radially outer surface of the annular body and a periphery of the combustor wall opening. The periphery may be configured to engage with the annular body so as to limit the relative movement of the combustor wall and the sealing element about the central point.

The sealing element may further comprise a first annular flange extending from the annular body between a proximal end and a distal end. The first annular flange may comprise the second bearing surface and the air passageway.

The first annular flange may additionally comprise a downstream surface offset from the second bearing surface. The downstream surface may partly define the combustion chamber and may be concave.

The distal end of the first annular flange comprises the air outlet.

The distal end of the first annular flange may be angled towards the interior surface.

The combustor wall may comprise a third bearing surface. The sealing element may comprise a second annular flange extending from the annular body. The second annular flange may comprise a fourth bearing surface. The first and third bearing surfaces may be disposed between the second and fourth bearing surfaces. The third bearing surface may form part of a third spherical surface and/or the fourth bearing surface may form part of a fourth spherical surface. The third bearing surface and the fourth bearing surface may be configured to contact and move relative to each other for relative movement of the combustor wall and the sealing element about the central point.

The third spherical surface may correspond to the fourth spherical surface.

The first and second annular flanges may define an annular groove. The combustor wall may be disposed within the annular groove.

The interior surface may be concave.

The interior surface may smoothly interface with the first bearing surface.

The sealing element may comprise a sealing element opening that slidably receives the fuel nozzle.

An inner surface of the sealing element opening and/or an exterior surface of the fuel nozzle that engages with the interior surface of the sealing element opening may form part of a toroidal surface.

The sealing element may comprise a plurality of air passageways.

The combustor wall may comprise a heatshield. The heatshield may comprise the first bearing surface and the third bearing surface.

DETAILED DESCRIPTION OF THE INVENTION

Figure 1:
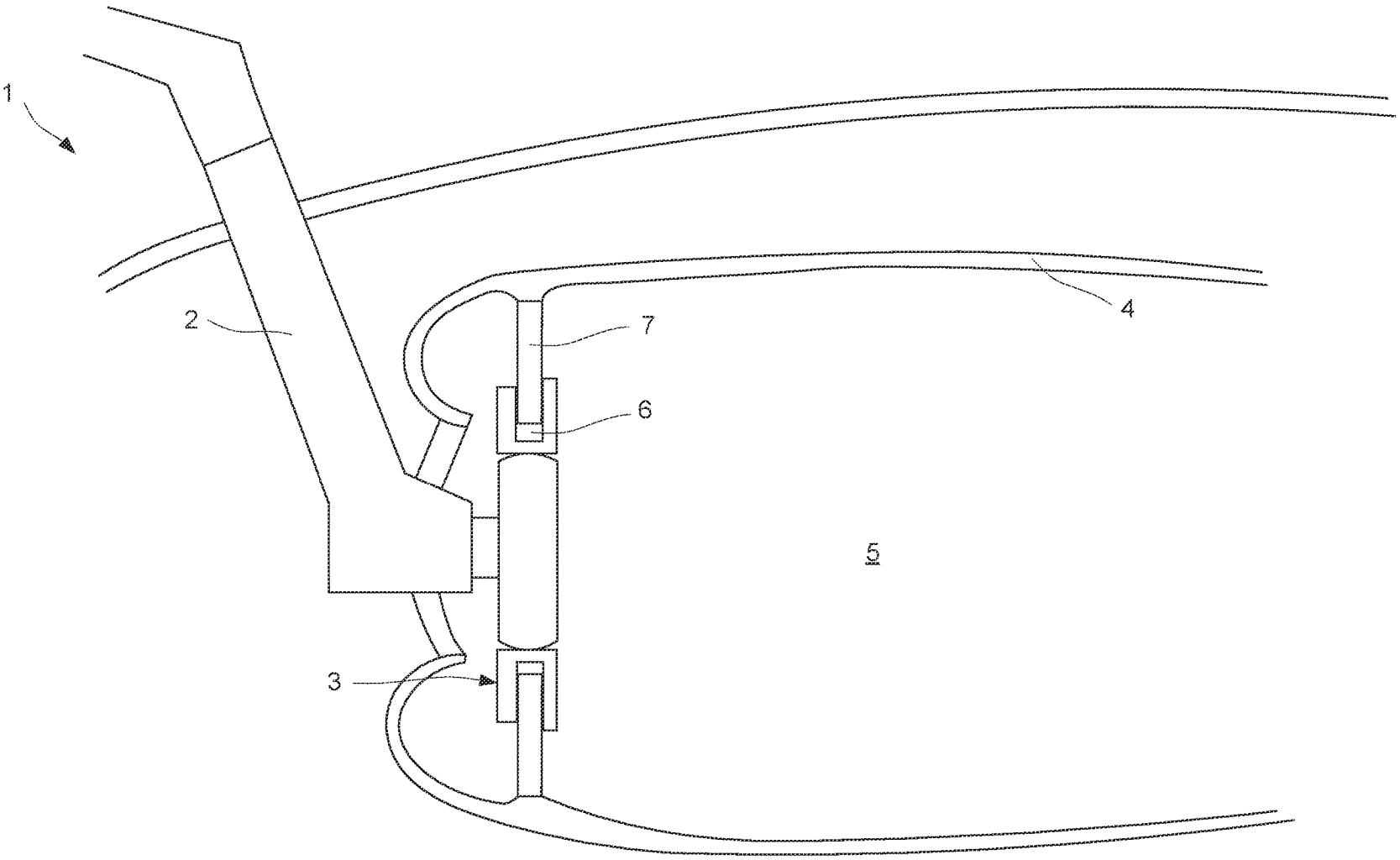
FIG. 1 is a cross-sectional view of a known combustor assembly.
Figure 2:
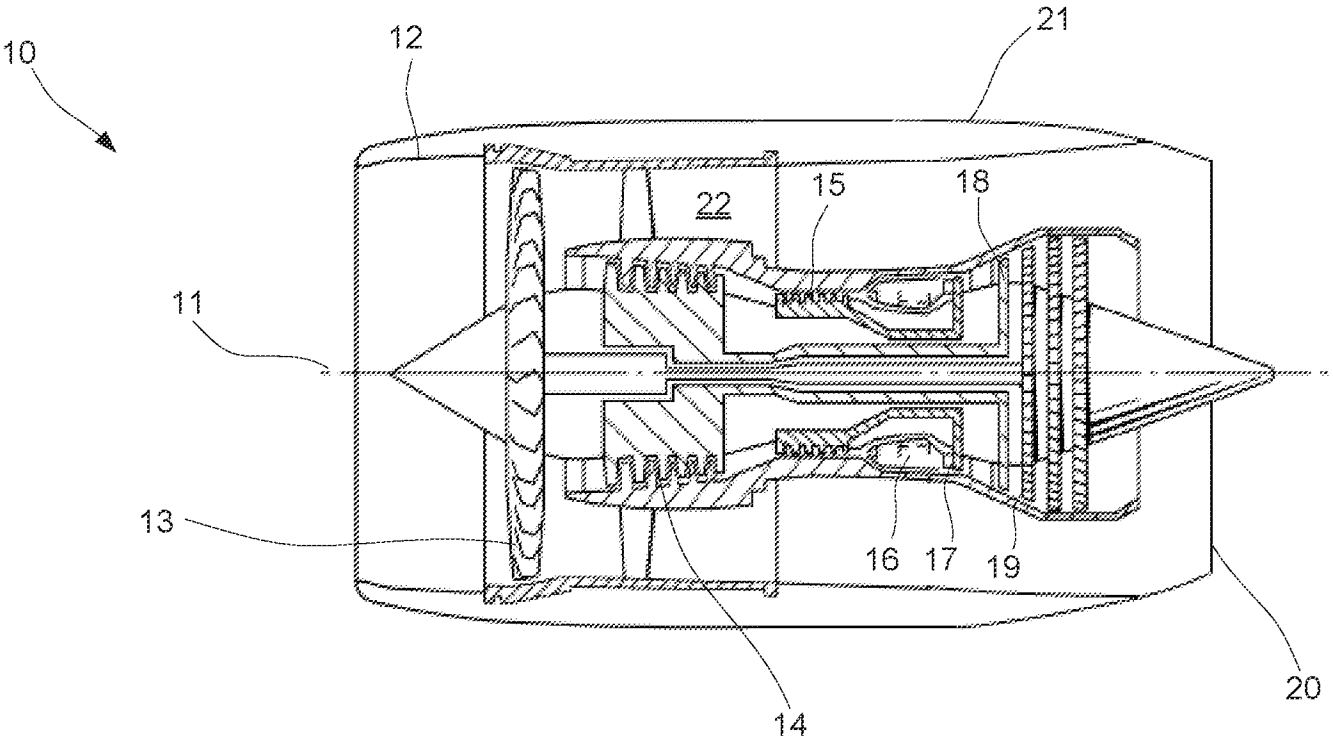
FIG. 2 is a cross-sectional view of an example gas turbine engine.

FIG. 2 is a cross-sectional view of a gas turbine engine 10 having a principal and rotational axis 11. The engine 10 comprises, in axial flow series, an air intake 12, a propulsive fan 13, an intermediate pressure compressor 14, a high-pressure compressor 15, combustion equipment 16, a high-pressure turbine 17, an intermediate pressure turbine 18, a low-pressure turbine 19 and an exhaust nozzle 20. A nacelle 21 generally surrounds the engine 10 and defines both the intake 12 and the exhaust nozzle 20.

The gas turbine engine 10 works in the conventional manner so that air entering the intake 12 is accelerated by the fan 13 to produce two air flows: a first air flow into the intermediate pressure compressor 14 and a second air flow which passes through a bypass duct 22 to provide propulsive thrust. The intermediate pressure compressor 14 compresses the air flow directed into it before delivering that air to the high-pressure compressor 15 where further compression takes place.

The compressed air exhausted from the high-pressure compressor 15 is directed into the combustion equipment 16 where it is mixed with fuel and the mixture combusted. The resultant hot combustion products then expand through, and thereby drive the high, intermediate and low-pressure turbines 17, 18, 19 before being exhausted through the nozzle 20 to provide additional propulsive thrust. The high 17, intermediate 18 and low 19 pressure turbines drive respectively the high-pressure compressor 15, intermediate pressure compressor 14 and fan 13, each by suitable interconnecting shafts.

Figure 3:
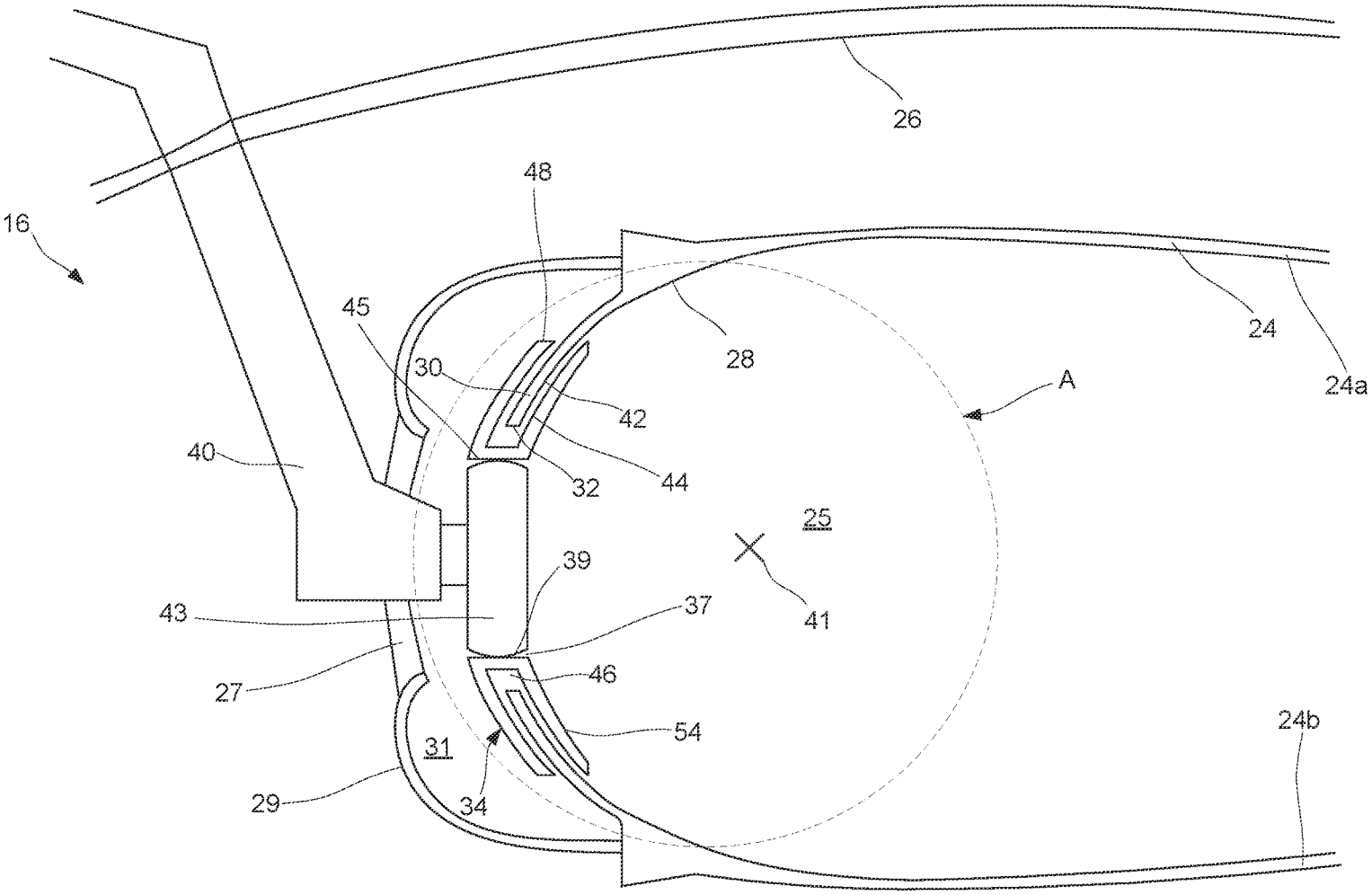
FIG. 3 is a cross-sectional view of a first example combustor assembly of the gas turbine engine.

Other gas turbine engines to which the present disclosure may be applied may have alternative configurations. By way of example such engines may have an alternative number of interconnecting shafts (e.g., two) and/or an alternative number of compressors and/or turbines. Further the engine may comprise a gearbox provided in the drive train from a turbine to a compressor and/or fan, FIG. 3 is a cross-sectional view of a first example combustor assembly 16 of the gas turbine engine 10. The combustor assembly 16 comprises a casing 26, which extends around the rotational axis 11 of the gas turbine engine 10. A liner 24 is positioned within the casing 26, The liner 24 defines a combustion chamber 25. The liner 24 comprises an annular shape. In particular, the liner 24 comprises a toroidal shape, extending circumferentially around a central axis which is substantially coaxial with the engine rotational axis 11. Accordingly, the liner can be said to comprise an outer wall 24*a* and an inner wall 24*b* which are radially spaced from one another with respect to the central axis of the liner 24. The inner wall 24*a* and outer wall 24*b* are connected at their upstream ends by a combustor wall 30 or bulkhead wall. The combustor wall 30 divides the combustor assembly 16 into a cooling chamber 31 and the combustion chamber 25. The terms "upstream" and "downstream" are used in this disclosure refer to the directions defined by the flow of fluid through the gas turbine engine 10.

The inner wall 24*a* and outer wall 24*b* extend upstream of the combustor wall 30 to form a domed combustor head 29, The combustor head 29 comprises a plurality of apertures 27. The plurality of apertures 27 are spaced circumferentially about the central axis. The plurality of apertures 27 are fluidically coupled to the compressor 15. Air delivered from the compressor 15 is able to enter the cooling chamber 31 via the apertures 27.

The combustor assembly 16 further comprises a plurality of fuel nozzles 40. The plurality of fuel nozzles 40 are configured to deliver fuel to the combustion chamber 25. The fuel nozzles 40 are suspended from the casing 26. Each fuel nozzle 40 extends through a respective one of the apertures 27. Each fuel nozzle 40 also extends into the combustion chamber 25 via a respective combustor wall opening 32 extending through the combustor wall 30. The combustor wall openings 32 form a circumferentially spaced array of combustor wall openings 32, which correspond to the circumferentially spaced apertures 27.

The fuel nozzle 40 comprises a swirler 43 at an outlet end of the fuel nozzle 40. The swirler 43 is configured to deliver high-pressure air from the compressor 15 to the combustion chamber 25 and to mix the fuel and air by imparting a swirling motion to the air. An outlet of the fuel nozzle 40 is received within the swirler 43. In other examples, the fuel nozzle 40 may not comprise a swirler 43.

The combustor wall 30 further comprises a first bearing surface 42 and a third bearing surface 47. The first and third bearing surfaces 42, 47 are located adjacent to the combustor wall opening 32. The first and third bearing surfaces 42, 47 extend circumferentially around the combustor wall opening 32. The first bearing surface 42 faces the combustion chamber 25. The third bearing surface 47 is formed on an opposing side of the combustor wall 30 with respect to the first bearing surface 42 and therefore faces away from the combustion chamber 25. The third bearing surface 47 forms part of a third spherical surface. The third bearing surface 47 extends circumferentially around the combustor wall opening 32. It will be appreciated that the term "bearing surface" as used in this disclosure relates to a surface which is configured to contact another respective bearing surface.

The combustor wall 30 further comprises an interior surface 28. The interior surface 28 is contiguous with the first bearing surface 42 and is radially offset from the first bearing surface 42 with respect to the combustor wall opening 32. Accordingly, the first bearing surface 42 is located between the combustor wall opening 32 and the interior surface 28. The interior surface 28 corresponds to the interior surface of the liner 24 (i.e. the surface that faces into the combustion chamber 25). The first bearing surface 42 and the interior surface 28 are integrally formed as part of the same wall section of the liner 24.

The first bearing surface 42 forms part of a first spherical surface having a central point 41 (i.e., a centre of the sphere). The first bearing surface 42 is concave. The interior surface 28 is also concave and has a profile which smoothly interfaces with the first bearing surface 42. In this example, the interior surface 28 forms part of a spherical surface. In other examples, the interior surface 28 may have a different concave profile. For example, the interior surface 28 may form part of a conical surface.

Figure 4:
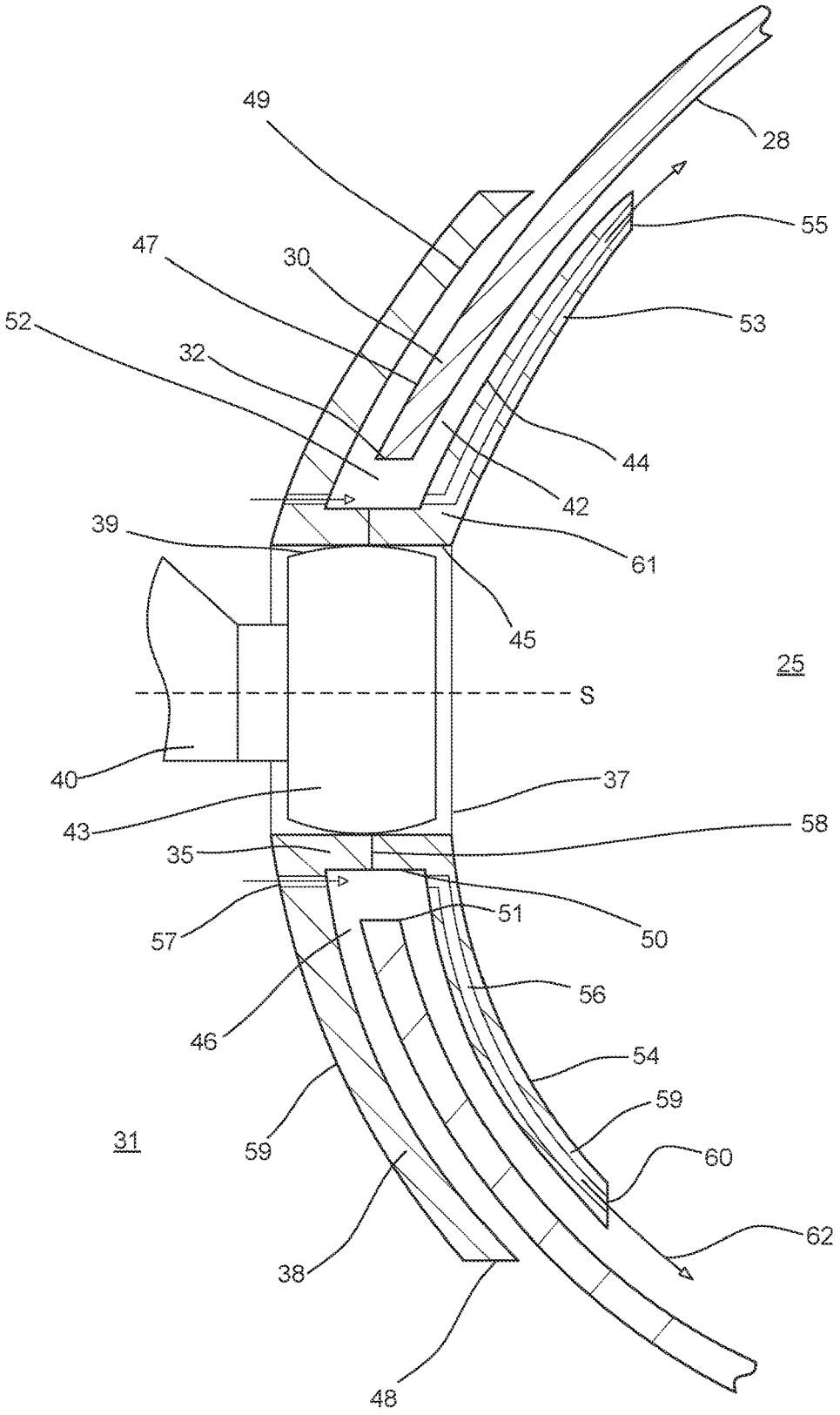
FIG. 4 is a closeup cross-sectional view of the region marked A in FIG. 3.

The combustor assembly 16 also comprises a sealing element 34 disposed at least partially within the combustor wall opening 32. The sealing element 34 forms an interface between the fuel nozzle 40 and the combustor wall 30. This interface is shown in detail in FIG. 4, which corresponds to the region marked A in FIG. 3.

The sealing element 34 comprises an annular body 35, first annular flange 53 and a second annular flange 38. The annular body 35 extends around a sealing element axis S. The annular body 35 defines a sealing element opening 37. The annular body 35 comprises an inner surface 45 and an outer surface 50. The inner surface 45 circumscribes the sealing element opening 37. The first annular flange 53 extends from the annular body 35 between a proximal end 61 and a distal end 55. It will be appreciated that in this disclosure the term "proximal end" refers to an end which is closer to the annular body than the "distal end". The annular flange 53 extends about the sealing element axis. The second flange 38 extends from the annular body 35 at an upstream position from the annular body 35 with respect to the first flange 53.

The sealing element 34 comprises a second bearing surface 44. The second bearing surface 44 is defined by the first flange 53. In particular, the second bearing surface 44 is formed on an upstream surface of the first flange 53. That is, the second bearing surface 44 faces away from the combustion chamber 25. The second bearing surface 44 extends about the sealing element axis S. The second bearing surface 44 forms part of a second spherical surface. The first spherical surface and second spherical surface correspond to each other such that they are configured to contact and slide against each other. The first spherical surface and the second spherical surface lie on spheres which share the same central point 41.

The first flange 53 further comprises a downstream surface 54 which is offset from the second bearing surface 44 on an opposing side of the first flange 53 relative to the second bearing surface 44. The downstream surface 54 therefore faces towards and partially forms a boundary of the combustion chamber 25. The downstream surface 54 is concave. The downstream surface 54 forms part of a spherical surface. In other examples, the downstream surface 54 may form part of a conical surface. The distal end 55 of the first flange 53 is angled towards the interior surface 28 of the combustor wall 30. In the present example, the distal end 55 is angled at an acute angle. In other examples, the downstream surface 54 and the distal end 55 form a single, smooth, continuous surface which is curved or angled towards the interior surface 28.

The annular body 35 defines a sealing element opening 37 extending therethrough. The sealing element opening 37 is configured to receive the fuel nozzle 40. In particular, an inner surface 45 of the sealing element opening 37 is configured to contact an outer surface 39 of the fuel nozzle 40, such that the sealing element opening 37 forms a seal with the fuel nozzle 40. The outer surface 39 of the fuel nozzle 40 is formed by the outer surface of the swirler 43. It will be understood that a "seal" as described in the present disclosure relates to a contact between two or more surfaces which completely or partially limits the flow of fluid therethrough. In other words, it will be understood that a seal may be completely or partially fluid-tight. In the present example, the inner surface 45 of the sealing element opening 37 is configured to slidingly engage the outer surface 39 of the fuel nozzle 40. This enables the fuel nozzle 40 to move relative to the sealing element 34. In this example, the fuel nozzle 40 is configured to move axially with respect to the sealing element opening 37. In addition, the fuel nozzle 40 is configured to rotate with respect to the sealing element opening 37 in a plane perpendicular to the sealing element axis S.

The outer surface 39 of the fuel nozzle 40 forms part of a toroidal surface. The inner surface 45 of the annular body 35 is cylindrical. The fuel nozzle 40 can therefore also rotate with respect to the sealing element opening 37 in a plane parallel to the sealing element axis S. In other examples, the inner surface 45 of the annular body 35 may alternatively form part of a toroidal surface, or both the inner surface 45 of the annular body 35 and the outer surface 39 of the fuel nozzle 40 may form part of respective toroidal surfaces.

The second flange 38 comprises a fourth bearing surface 49, which faces towards the combustion chamber 25. The fourth bearing surface 49 also faces towards the third bearing surface 47 of the combustor wall 30. The first and the third bearing surfaces 42, 47 are disposed between the second and fourth bearing surfaces 44, 49. The fourth bearing surface 49 forms part of a fourth spherical surface. The fourth bearing surface 49 extends about the sealing element axis S. The third spherical surface and the fourth spherical surface correspond to one another, in that they are shaped to contact and slide against one another. The third spherical surface and the fourth spherical surface lie on spheres which share the same central point 41.

The second flange 38 also comprises an upstream surface 59, which faces towards the cooling chamber 31. The upstream surface 59 of the second flange 38 is convex. The upstream surface 59 forms part of a spherical surface. In other examples, the upstream surface may form part of a conical surface.

An annular groove 46 is defined by the first and second flanges 53, 38. The combustor wall 30 is disposed at least partially within the annular groove 46 of the sealing element 34. In other examples, the sealing element 34 may define spaces of any suitable shape and size in which the combustor wall 30 can be at least partially disposed. A clearance 52 is formed between the periphery 51 of the combustor wall opening 32 and the outer surface 50 of the annular body 35. The clearance 52 enables the combustor wall 30 to move within the annular groove 46 and relative to the sealing element 34. The clearance 52 has an annular shape and is variable in a radial direction depending on the relative positions of the sealing element 34 and the combustor wall 30.

The sealing element 34 can be cast in two halves; a first half incorporating the first flange 53 and part of the annular body 35, and a second half incorporating the second flange 38 and the other part of the annular body 35. The two halves can be brazed together around the combustor wall opening 32 at a joint 58.

The first bearing surface 42 is configured to contact the second bearing surface 44 and move relative to the second bearing surface 44. In addition, the third bearing surface 47 is configured to contact the fourth bearing surface 49 and move relative to the fourth bearing surface 49. In particular, the first bearing surface 42 is configured to contact the second bearing surface 44 and slide along the second bearing surface 44, and the third bearing surface 47 is configured to contact the fourth bearing surface 49 and slide along the fourth bearing surface 49. In the example shown, a small gap is present in an axial direction between the combustor wall 30 and the annular groove 46. This enables either one or both of the first bearing surface 42 or the third bearing surface 47 to contact and move relative to the second bearing surface 44 and fourth bearing surface 49, respectively, at any given time.

By having bearing surfaces which form part of respective spherical surfaces, the sealing element 34 and the combustor wall 30 are configured to move spherically relative to each other. That is, the sealing element 34 and the combustor wall 30 are configured to move relative to each other about the central point 41 of the first spherical surface. This enables relative rotation between the sealing element 34 and the combustor wall 30 in any direction around the central point 41 of the first spherical surface. In addition, when the third bearing surface 47 contacts and slides against the fourth bearing surface 49, the sealing element 34 and the combustor wall 30 are configured to move relative to each other about a central point 41 of the third spherical surface. In the present example, the first spherical surface and the third spherical surface share the same central point 41.

The extent of the relative movement between the sealing element 34 and the combustor wall 30 is limited by the size of the clearance 52 between the periphery 51 of the combustor wall opening 32 and the radially outer surface 50 of the annular body 35. The radially outer surface 50 of the annular body 35 is configured to contact and engage the periphery 51 to limit the motion of the annular body 35 within the combustor wall opening 32 and thereby limit the extent of the relative movement between the sealing element 34 and the combustor wall 30 about the central point 41 of the first spherical surface. The periphery 51 of the combustor wall opening 32 is circular and the radially outer surface 50 of the annular body 35 is cylindrical. Accordingly, the total clearance between the periphery 51 and the radially outer surface 50 is equal in all directions.

Figure 5:
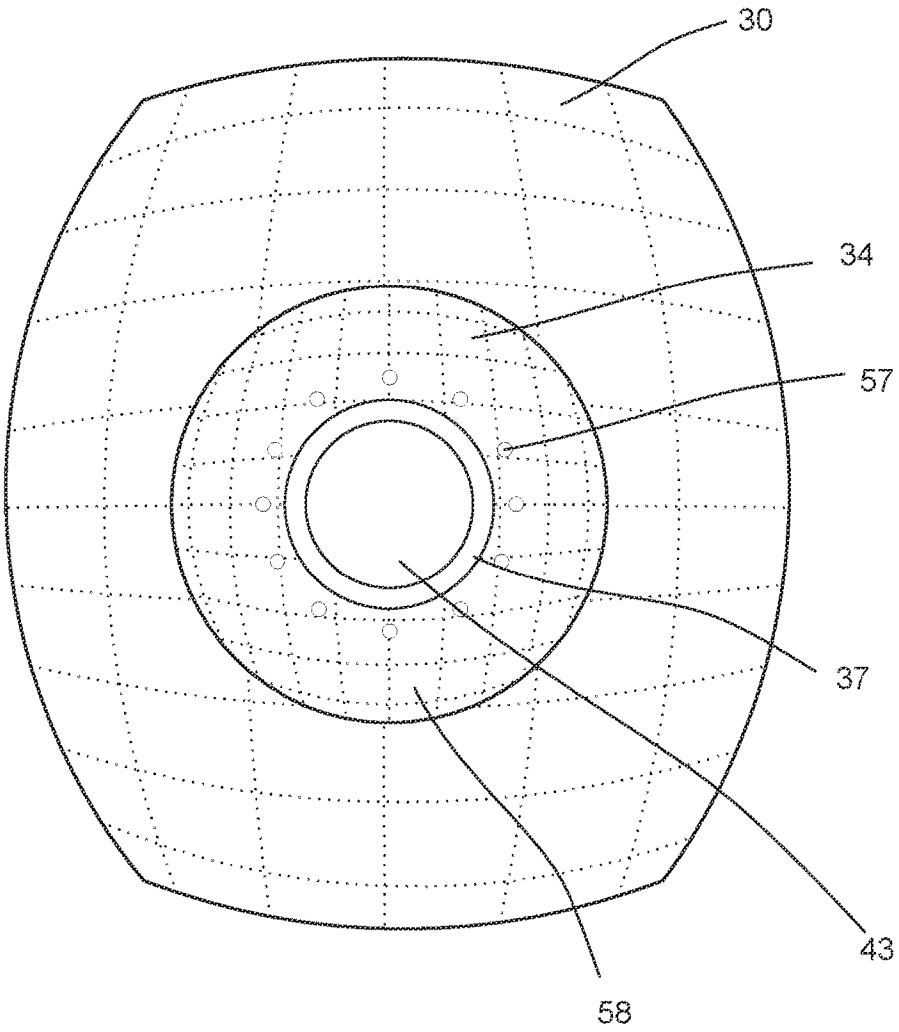
FIG. 5 is an end view of the example combustor assembly from an upstream side of the first example combustor assembly.

The sealing element 34 further comprises an air passageway 56 extending through the sealing element 34 from an air inlet 57 to an air outlet 60. More specifically, in this example, a plurality of air passageways 56 are provided through the sealing element 34. FIG. 5 shows the combustor assembly 16 viewed from an upstream end thereof (i.e. viewed from the cooling chamber 31). The plurality of air passageways 56 have respective air inlets 57 formed on an upstream side of the second annular flange 38 of the sealing element 34. The air inlets 57 are circumferentially spaced about the sealing element axis S. Each air passageway 56 extends through the second flange 38 from the air inlet 57 into the annular groove 46. Each air passageway 56 subsequently extends from the annular groove 46 through the first flange 53 and terminates at a respective air outlet 60. The passageway 56 is curved to correspond to the curvature of the first flange 53. The respective air outlets 60 are formed at the distal end 55 of the first flange 53.

Figure 6:
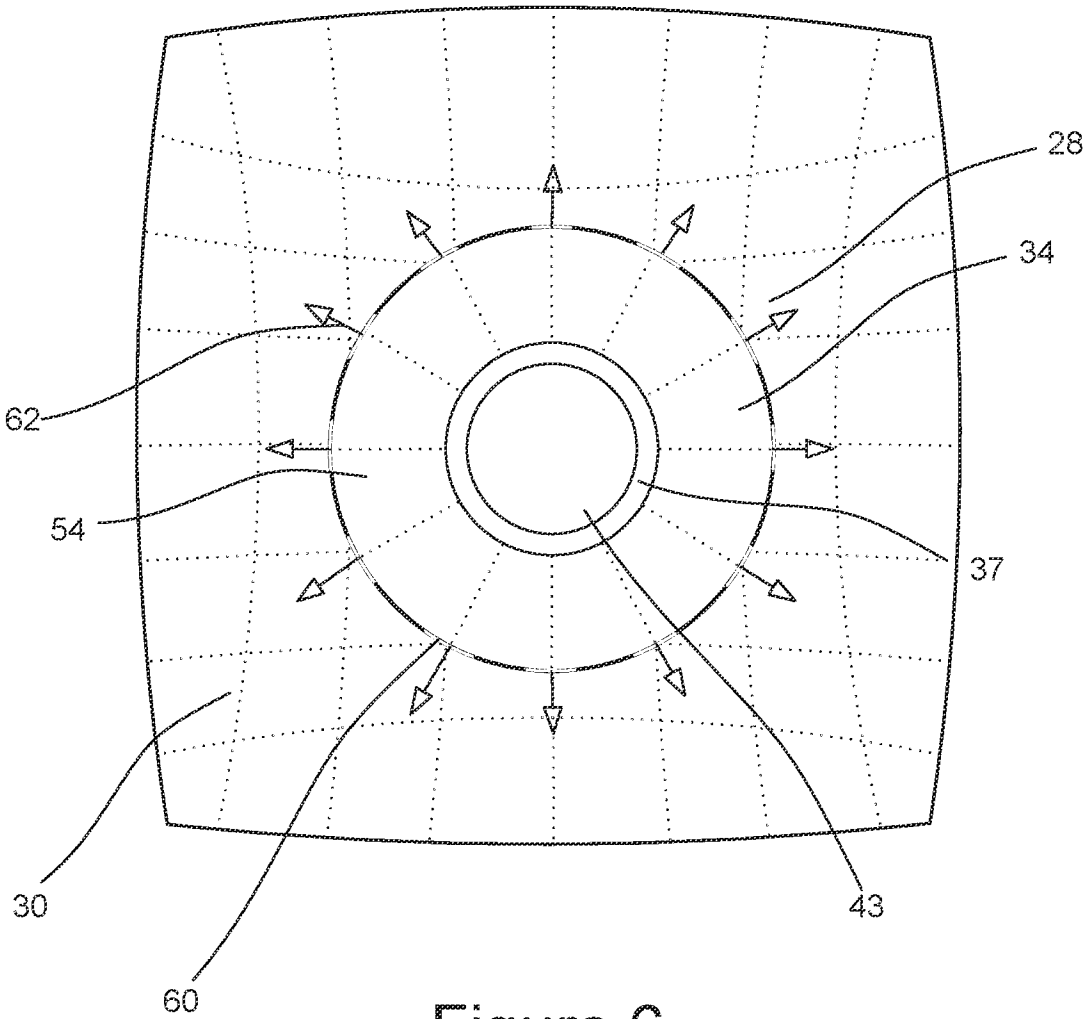
FIG. 6 is an end view of the example combustor assembly from a downstream side of the first example combustor assembly.

FIG. 6 shows the combustor assembly 16 as viewed from a downstream end thereof (i.e., from the combustion chamber 25). The plurality of air passageways 56 have respective air outlets 60 formed at the distal end 55 of the first flange 53. The air outlets 60 are circumferentially spaced about the sealing element axis S.

The air passageways 56 fluidically couple the cooling chamber 31 and the combustion chamber 25. The cooling chamber 31 contains air from the compressor which is at a relatively lower temperature than the air within the combustion chamber 25, which is at a high temperature due to the combustion process taking place therewithin. Accordingly, the air passageways 56 are configured to deliver a flow of air from the cooling chamber 31 to the combustion chamber 25. As the air outlet 60 is formed at the distal end 55 of the first flange 53, air leaving the air outlet 60 forms a film 62 across the interior surface 28 of the combustor wall 30.

During operation of the engine, fuel is injected or sprayed from the fuel nozzle 40 into the combustion chamber 25 along with high-pressure air from the compressor 15. The fuel-air mixture is combusted within the combustion chamber 25. A portion of air from the compressor 15 enters the cooling chamber 31 via the aperture 27 and flows through one or more of the air inlets 57 on the upstream side of the second flange 38 to enter a respective air passageway 56. After passing through the second flange 38, the air enters the clearance 52 of the sealing element 34, where it subsequently enters the air passageway 56 formed in the first flange 53. The first flange 53 is exposed to high temperatures as it faces the combustion chamber 25, where combustion of a mixture of fuel and high-pressure air causes the temperature of the first flange 53 to increase. As the relatively cool air flows along the air passageway 56 of the first flange 53, heat is transferred from the first flange 53 to the air within the passageway 56, thereby cooling the first flange 53. The air therefore provides internal cooling for the sealing element 34. The air leaves the passageway at the air outlet 60. As the air outlet 60 is formed at the distal end 55 of the first flange 53, the air leaves the passageway 56 in a direction substantially parallel to the interior surface 28 of the combustor wall 30, such that the air forms a film 62 across the interior surface 28. The film of air 62 acts to cool the interior surface 28 of the combustor wall 30 and thereby protects the interior surface 28 from the hot combustion gases within the combustion chamber 25.

Due to the concave shape of the combustor wall 30, the film of air 62 remains attached to the interior surface 28. This reduces the likelihood of the film of air 62 being detached quickly from the interior surface 28 and mixing with the hot combustion gases, which can disrupt the combustion process within the combustion chamber 25. It also helps to reduce the likelihood of the film of air 62 recirculating within the combustion chamber 25 and causing localised regions of turbulent air, which is undesirable. The improved control of cooling air flow therefore reduces the production of particulate and gaseous emissions and improves combustion efficiency and flame stability. In addition, the concave shape of the downstream surface 54 of the first flange 53, and the distal end 55 of the first flange 53 being angled towards the interior surface 28 provide a smooth boundary between the sealing element 34 and the interior surface 28. This further helps to reduce the occurrence of turbulence adjacent to the combustor wall 30, which ensures that residence times for gases at different points within the combustion chamber 25 are consistent.

The first spherical surface of the combustor wall 30 and its interface with the sealing element 34 enables the sealing element 34 to move relative to the combustor wall 30 about the centre point 41 of the first spherical surface. As the fuel nozzle 40 forms a seal with the sealing element opening 45 of the sealing element 34, the hot combustion gases are substantially prevented from leaking out of the combustion chamber 25 to the upstream side of the sealing element 34. Additionally, because the sealing element 34 forms an interface between the fuel nozzle 40 and the combustor wall 30, the fuel nozzle 40 is also able to move relative to the combustor wall 30 about the centre point 41 of the first spherical surface. This enables the fuel nozzle 40 to move relative to the combustor wall 30 as a result of thermal expansion and contraction due to the changing temperatures of the combustor assembly 16 and casing 26 in use, whilst remaining fluidically coupled to the combustion chamber 25 at all possible relative positions. Thereby, the flow of fuel and air into the combustion chamber 25 can be accurately controlled even at varying relative positions of the fuel nozzle 40 and the combustor wall 30. This helps maximise combustor efficiency.

Figure 7:
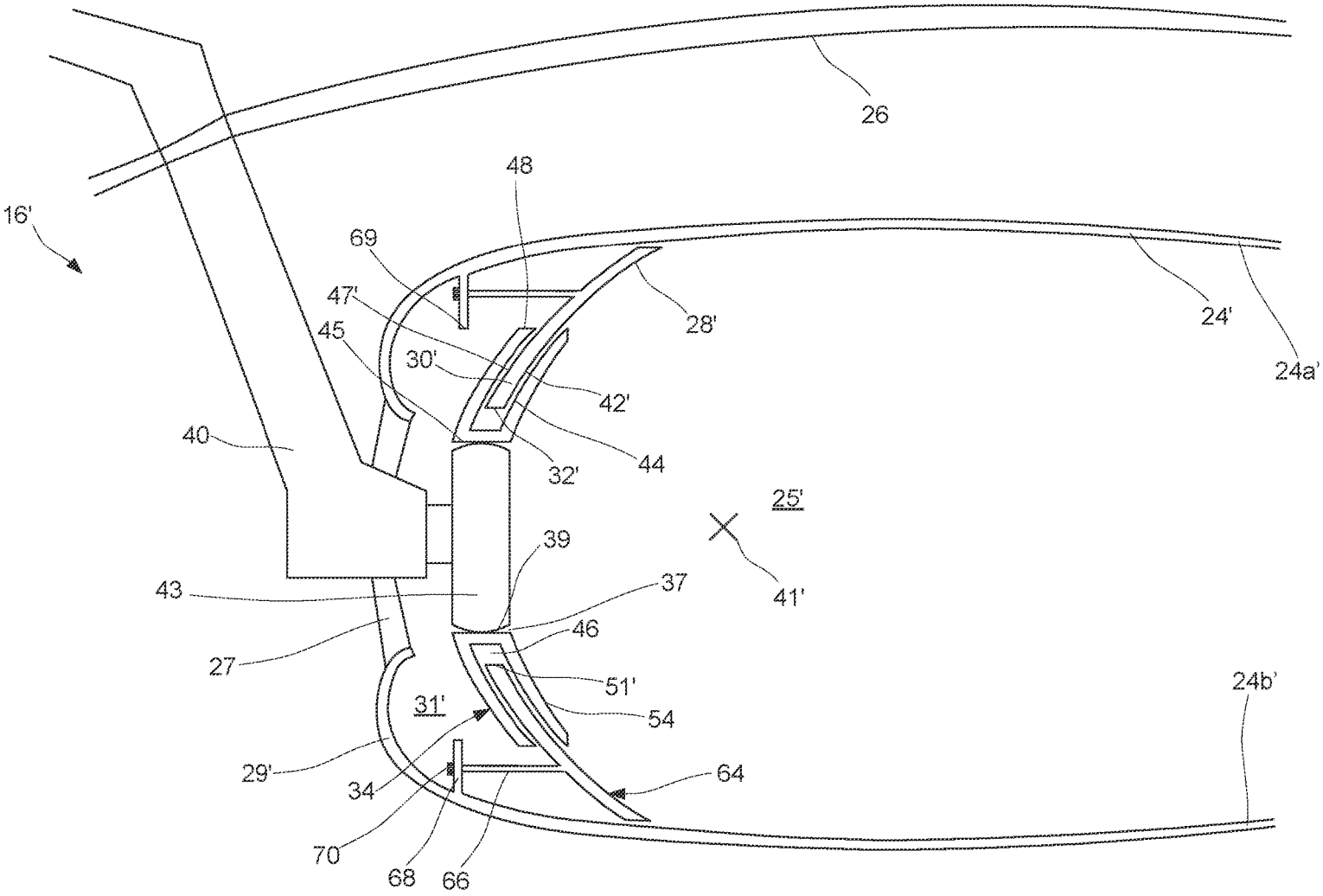
FIG. 7 is a cross-sectional view of a second example combustor assembly of the gas turbine engine.

FIG. 7 is a cross-sectional view of a second example combustor assembly 16' of the gas turbine engine 10. The second example combustor assembly 16' is substantially similar to the first example combustor assembly 16, with like reference numerals denoting like features and modified features denoted with reference numerals having an added apostrophe. The second example combustor assembly 16' differs from the first example combustor assembly 16 in how the combustor wall is formed.

As for the first example, the second example combustor assembly 16' comprises a casing 26, which extends around the rotational axis 11 of the gas turbine engine 10. A liner 24' is positioned within the casing 26. The liner 24' defines a combustion chamber 25'. The liner 24' comprises an annular shape. In particular, the liner 24' comprises a toroidal shape, extending circumferentially around a central axis which is substantially coaxial with the engine rotational axis 11. Accordingly, the liner can be said to comprise an outer wall 24*a*' and an inner wall 24*b*' which are radially spaced from one another with respect to the central axis of the liner 24'.

The inner wall 24*a*' and outer wall 24*b*' are connected at their upstream ends by a panel 68. A heatshield 64 is mounted to the panel 68 and is located downstream of the panel 68. The heatshield 64 forms a combustor wall 30' which divides the combustor assembly 16' into a cooling chamber 31' and the combustion chamber 25'. The heatshield 64 comprises a protrusion 66 extending from an upstream surface thereof. The protrusion 66 is attached to the panel 68 by fasteners 70. The fasteners 70 may be any suitable fasteners, for example bolts or screws. The panel 68 is planar. In other examples, the panel 68 may be approximately planar or conical. In further examples, the panel 68 may have a profile which corresponds to that of the heatshield 64.

The inner wall 24*a*' and outer wall 24*b*' extend upstream of the panel 68 to form a domed combustor head 29'. The combustor head 29' comprises a plurality of apertures 27. The plurality of apertures 27 are spaced circumferentially about the central axis. The plurality of apertures 27 are fluidically coupled to the compressor 15. Air delivered from the compressor 15 is able to enter the cooling chamber 31' via the apertures 27.

As in the first example, a fuel nozzle 40 extends through a respective one of the apertures 27. Each fuel nozzle 40 also extends through a respective panel aperture 69 extending through the panel 68. The panel apertures 69 form a circumferentially spaced array of panel apertures 69, which correspond to the circumferentially spaced apertures 27. Each fuel nozzle 40 extends into the combustion chamber 25' via a respective combustor wall opening 32' extending through the combustor wall 30' formed by the heatshield 64. The combustor wall openings 32' form a circumferentially spaced array of combustor wall openings 32', which correspond to the circumferentially spaced apertures 27 and the circumferentially spaced panel apertures 69.

The combustor wall 30' formed by the heatshield 64 comprises a first bearing surface 42' and a third bearing surface 47'. The first and third bearing surfaces 42', 47' are located adjacent to the combustor wall opening 32'. The first and third bearing surfaces 42', 47' extend circumferentially around the combustor wall opening 32'. The first bearing surface 42' faces the combustion chamber 25'. The third bearing surface 47' is formed on an opposing side of the combustor wall 30' with respect to the first bearing surface 42' and therefore faces away from the combustion chamber 25'. The third bearing surface 47' forms part of a third spherical surface. The third bearing surface 47' extends circumferentially around the combustor wall opening 32'.

The combustor wall 30' further comprises an interior surface 28'. The interior surface 28' is contiguous with the first bearing surface 42' and is radially offset from the first bearing surface 42' with respect to the combustor wall opening 32'. Accordingly, the first bearing surface 42' is located between the combustor wall opening 32' and the interior surface 28'. The interior surface 28' faces into the combustion chamber 25'. The interior surface 28' is adjacent to the interior surface of the liner 24' which also faces into the combustion chamber 25'.

Similar to the first example, the first bearing surface 42' forms part of a first spherical surface having a central point 41' (i.e., a centre of the sphere). The first bearing surface 42' is concave. The interior surface 28' is also concave and has a profile which smoothly interfaces with the first bearing surface 42'. In this example, the interior surface 28' forms part of a spherical surface. In other examples, the interior surface 28' may have a different concave profile. For example, the interior surface 28' may form part of a conical surface.

As in the first example, the second example combustor assembly 16' also comprises a sealing element 34 disposed at least partially within the combustor wall opening 32'. The sealing element 34 forms an interface between the fuel nozzle 40 and the combustor wall 30' defined by the heatshield 64. The sealing element 34 is similar to the sealing element described in the first example combustor assembly 16.

The operation of the second example combustor assembly 16' is substantially similar to that described with respect to the first example combustor assembly 16. Accordingly, the advantages described with respect to the first example combustor assembly 16 also apply to the second example combustor assembly 16'. In addition, due to the presence of the heatshield 64, upstream regions of the combustor assembly 16', such as the panel 68, combustor head 29', and fuel nozzle 40 are further protected from the hot combustion gases within the combustion chamber 25.

Although it has been described in the first example that the first bearing surface 42 and the interior surface 28 are integrally formed as part of the same wall section of the liner 24, in other examples the first bearing surface 42 and the interior surface 28 may be formed on separate walls which are attached together so that the first bearing surface 42 and the interior surface 28 are contiguous.

Although it has been described that the first spherical surface and the second spherical surface lie on spheres which share the same central point. However, in other examples, the first spherical surface and the second spherical surface can lie on spheres which have different central points, which still allow the surfaces to contact and slide against one another. For example, the second spherical surface may have a smaller radius than the first spherical surface.

Similarly, although it has been described that the third spherical surface and the fourth spherical surface lie on spheres which share the same central point, in other examples the third spherical surface and the fourth spherical surface can lie on spheres which have different central points, which still allow the surfaces to contact and slide against one another. For example, the third spherical surface may have a smaller radius than the fourth spherical surface.

Although it has been described that the periphery 51 of the combustor wall opening 32 is circular and the radially outer surface 50 of the annular body 35 is cylindrical, in other examples, the periphery 51 and the radially outer surface 50 may be differently shaped and sized such that the total clearance between the periphery 51 and the radially outer surface is different in one or more directions with respect to the other directions. For example, the periphery 51 of the combustor wall opening 32 may be elliptical, whilst the radially outer surface 50 of the annular body 35 is cylindrical.

Although it has been described that the passageway 56 is curved to correspond to the curvature of the first flange 53, in other examples the passageway 56 may be linear. Although it has been described that the air outlet 60 is formed at the distal end 55 of the first flange 53, in other examples the air outlet 60 may be formed through the second bearing surface 44 of the first flange 53.

Although it has been described that the combustor assembly 16, 16' comprises a domed combustor head 29, 29' upstream of the combustor wall 30, 30', in other examples, the combustor assembly 16, 16' may not comprise a combustor head 29, 29'. Instead, each fuel nozzle 40 extends directly into the combustion chamber via the respective combustor wall opening 32, 32'. In addition, the cooling chamber 31 is defined by the region upstream of the combustor wall 30, 30'. The convex profiles of the upstream surface 59 of the first flange 38 of the sealing element 34 and the third bearing surface 47, 47' of the combustor wall 30, 30' provide a convex external profile of the combustor liner 24, 24'. This enables air to flow smoothly into the combustion chamber 25, 25' and around the exterior of the combustor liner 24, 24', such that the need for a domed combustor head 29, 29' is obviated.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

What is claimed is:

1. A combustor assembly for a gas turbine engine, the combustor assembly comprising:

a combustor wall comprising an interior surface and a combustor wall opening, wherein the interior surface at least partly defines a combustion chamber, wherein the combustor wall opening extends between the combustion chamber and an exterior of the combustion chamber;

a sealing element disposed at least partially within the combustor wall opening, the sealing element comprising an air inlet, an air outlet and an air passageway fluidically coupling the air inlet and the air outlet, wherein the air outlet exits into the combustion chamber and is configured to deliver a flow of air received from the exterior of the combustion chamber via the air inlet and the air passageway to the combustion chamber; and a fuel nozzle coupled to the sealing element and configured to deliver fuel into the combustion chamber, wherein the combustor wall further comprises a first bearing surface and the sealing element further comprises a second bearing surface, wherein the first bearing surface and the second bearing surface are configured to contact and move relative to each other, wherein the first bearing surface is concave and forms part of a first spherical surface such that the first bearing surface and the second bearing surface are configured to move relative to each other about a central point of the first spherical surface, wherein the sealing element comprises an annular body, wherein a variable annular clearance is defined between a radially outer surface of the annular body and a periphery of the combustor wall opening, wherein the periphery is configured to engage with the annular body so as to limit the relative movement of the combustor wall and the sealing element about the central point, wherein the sealing element further comprises a first annular flange extending from the annular body between a proximal end and a distal end, wherein the first annular flange comprises the second bearing surface and the air passageway, and wherein the distal end of the first annular flange comprises the air outlet.

2. The combustor assembly as claimed in claim 1, wherein the second bearing surface forms part of a second spherical surface.

3. The combustor assembly as claimed in claim 1, wherein the first annular flange additionally comprises a downstream surface offset from the second bearing surface, wherein the downstream surface partly defines the combustion chamber and is concave.

4. The combustor assembly as claimed in claim 1, wherein the distal end of the first annular flange is angled towards the interior surface.

5. The combustor assembly as claimed in claim 1, wherein:

the combustor wall comprises a third bearing surface;

the sealing element comprises a second annular flange extending from the annular body;

the second annular flange comprises a fourth bearing surface;

the first and third bearing surfaces are disposed between the second and fourth bearing surfaces;

the third bearing surface forms part of a third spherical surface and/or the fourth bearing surface forms part of a fourth spherical surface; and the third bearing surface and the fourth bearing surface are configured to contact and move relative to each other for relative movement of the combustor wall and the sealing element about the central point.

6. The combustor assembly as claimed in claim 5, wherein the third spherical surface corresponds to the fourth spherical surface.

7. The combustor assembly as claimed in claim 5, wherein the first and second annular flanges define an annular groove, wherein the combustor wall is disposed within the annular groove.

8. The combustor assembly as claimed in claim 1, wherein the interior surface is concave.

9. The combustor assembly as claimed in claim 1, wherein the interior surface smoothly interfaces with the first bearing surface.

10. The combustor assembly as claimed in claim 1, wherein the sealing element comprises a sealing element opening that slidably receives the fuel nozzle.

11. The combustor assembly as claimed in claim 10, wherein an inner surface of the sealing element opening and/or an exterior surface of the fuel nozzle that engages with the interior surface of the sealing element opening forms part of a toroidal surface.

12. The combustor assembly as claimed in claim 1, wherein the sealing element comprises a plurality of additional air passageways.

13. The combustor assembly as claimed in claim 1, wherein the combustor wall comprises a heatshield, wherein the heatshield comprises the first bearing surface and a third bearing surface.

* * * * *